US012215949B2

(12) United States Patent
Noonan et al.

(10) Patent No.: US 12,215,949 B2
(45) **Date of Patent: *Feb. 4, 2025**

(54) HANDGUN HAVING METALLIC RAILS WITHIN A POLYMERIC FRAME

(71) Applicants: Paul T. Noonan, Boise, ID (US); Aaron Neal Trout, Fayetteville, AR (US)

(72) Inventors: Paul T. Noonan, Boise, ID (US); Aaron Neal Trout, Fayetteville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/071,842

(22) Filed: Nov. 30, 2022

(65) Prior Publication Data

US 2023/0086072 A1 Mar. 23, 2023

Related U.S. Application Data

(63) Continuation of application No. 17/246,908, filed on May 3, 2021, now Pat. No. 11,543,197, which is a continuation of application No. 16/250,072, filed on Jan. 17, 2019, now Pat. No. 11,022,387.

(60) Provisional application No. 62/618,688, filed on Jan. 18, 2018.

(51) Int. Cl.
*F41A 3/66* (2006.01)
*F41C 23/10* (2006.01)
*F41C 23/18* (2006.01)

(52) U.S. Cl.
CPC ..... *F41A 3/66* (2013.01); *F41C 23/10* (2013.01); *F41C 23/18* (2013.01)

(58) Field of Classification Search
CPC ..... F41A 3/66; F41C 23/10; F41C 23/18
USPC ..... 42/14, 16
See application file for complete search history.

(56) References Cited

U.S. PATENT DOCUMENTS

| | | | | |
|---|---|---|---|---|
| 5,669,169 A * | 9/1997 | Schmitter | F41A 3/66 89/196 |
| 5,717,156 A * | 2/1998 | Lenkarski | F41A 3/64 89/196 |
| 6,401,379 B1 * | 6/2002 | Moon | F41C 23/18 42/71.01 |
| 11,022,387 B1 * | 6/2021 | Noonan | F41A 3/66 |
| 11,543,197 B2 * | 1/2023 | Noonan | F41A 3/66 |

* cited by examiner

*Primary Examiner* — Bret Hayes

(57) ABSTRACT

A handgun is disclosed. The handgun contains a frame composed of polymer material, the frame contains a channel formed therein, wherein the channel contains sides, and a forward rail positioned within the channel.

10 Claims, 15 Drawing Sheets

HANDGUN HAVING METALLIC RAILS WITHIN A POLYMERIC FRAME

CROSS REFERENCE TO RELATED APPLICATIONS

This application is a continuation of U.S. patent application Ser. No. 17/246,908 titled "Handgun Having Metallic Rails Within A Polymeric Frame" filed May 3, 2021, now issued U.S. Pat. No. 11,543,197, which is incorporated herein by reference in its entirety. U.S. patent application Ser. No. 17/246,908 is a continuation of U.S. patent application Ser. No. 16/250,072 titled "Handgun Having Metallic Rails Within A Polymeric Frame" filed Jan. 17, 2019, now issued U.S. Pat. No. 11,022,387, which is incorporated herein by reference in its entirety. U.S. patent application Ser. No. 16/250,072 claims the benefit of U. S. Provisional Application No. 62/618,688, filed on Jan. 18, 2018, which is incorporated herein by reference in its entirety.

FIELD

The present invention relates to handguns. More particularly, the present invention relates to handguns having metallic rails within a polymeric frame.

BACKGROUND

In recent years there has been a trend in the handgun industry to utilize polymers in the manufacture of semi-automatic pistols, particularly in fabricating unitary frames by injection molding techniques. Generally, such frames are adapted to receive a metal slide removably fitted onto the frame for slidable reciprocal movement therealong. The slide is usually secured for such movement by longitudinally spaced pairs of metal rails partially embedded in the polymer of the frame. The rails provide durable metal-to-metal contact, as with tongue and groove fittings for slidable inter-engagement between the frame and slide which are characterized by superior wear and reliable operation.

It is inherently impossible for a frame composed of polymeric and metallic materials to be formed as an integral unit. Consequently, different manufacturing techniques have been devised in order to combine two or more materials into a single frame. Conventional polymer frame handguns have generally either incorporated the metal rails into the polymer during the molding process of the polymer or utilized metal rails having portions mounted within receptacles formed in the polymer during the molding process. Each of these conventional methods has certain disadvantages.

Frames manufactured by the conventional process utilize a plurality of metal rail components which must each, individually, be partially encased in the polymer material of the frame during the molding process or partially inserted into receptacles formed in the frame during the molding process. As a result, these processes are labor intensive and expensive. Consequently, there is a need for a new handgun frame and method of assembling the frame that enables the combination and cooperation of polymeric and metallic materials into its construction.

The mechanical strength characteristics of the materials from which polymer handgun frames are generally manufactured are inferior to those of the materials of metallic handgun frames, To compensate, conventional polymer handgun frames are manufactured such that the portions of the frame which are subject to the greatest amount of stress during firing of the handgun (or in some cases the entire polymer handgun frame) have a greater thickness than comparable portions of metallic handgun frames. Such differences generally result in a less aesthetically pleasing look for the handgun. The differences may also make the handgun less comfortable to grip.

Accordingly, a need exists for improvements that addresses the foregoing and other related and unrelated problems in the art.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1:
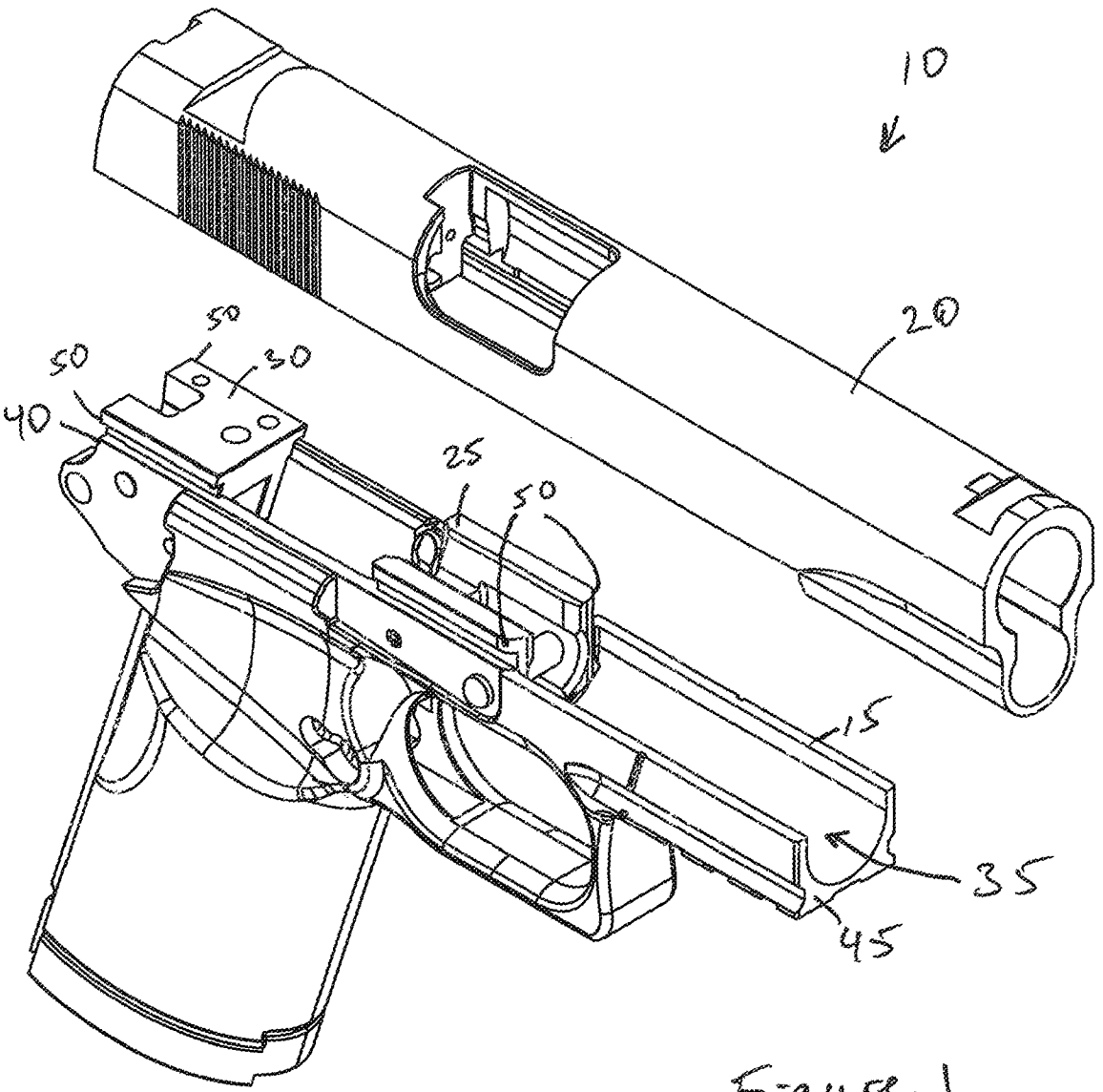
FIG. 1 depicts a perspective view of a portion of a handgun according to some embodiments presently disclosed.
Figure 2:
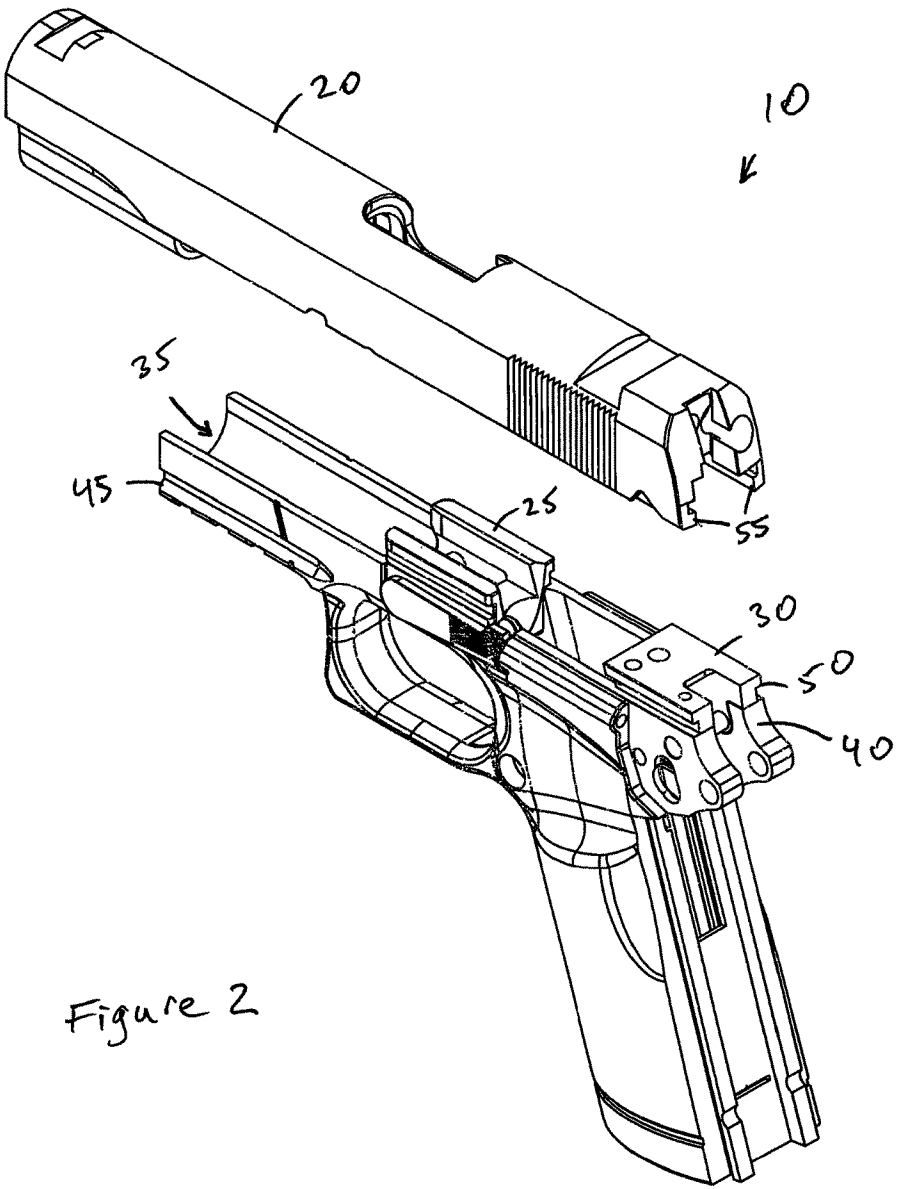
FIG. 2 depicts another perspective view of the portion of the handgun shown in FIG. 1.
Figure 3:
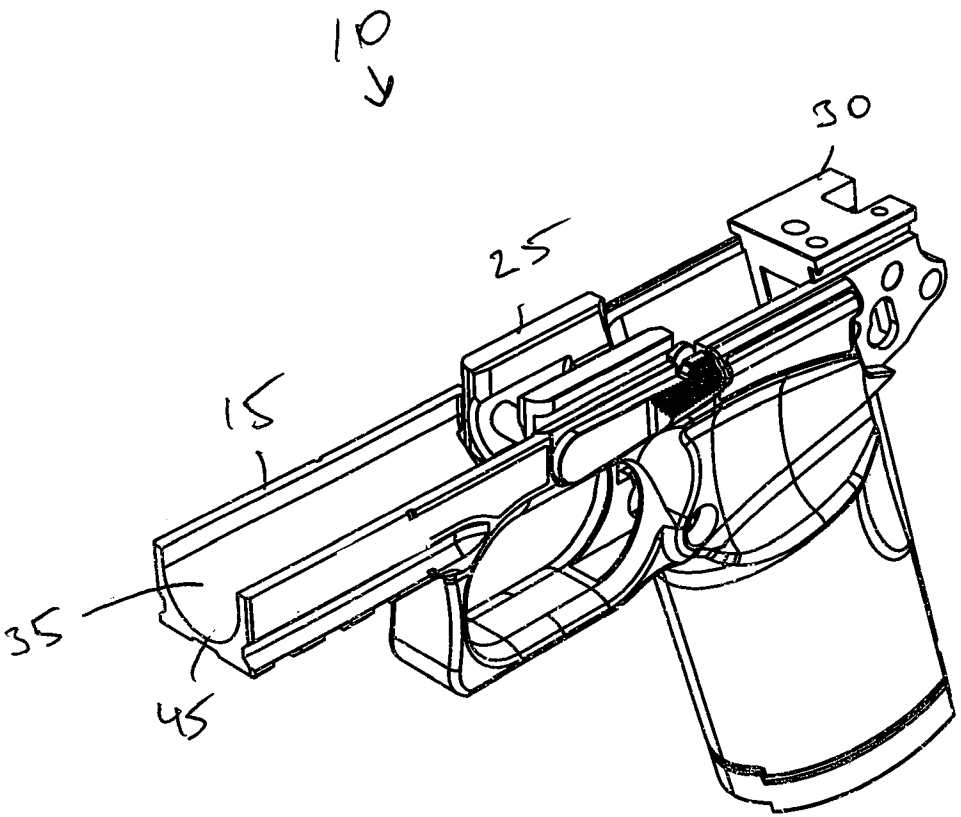
FIG. 3 depicts another perspective view of a portion of a handgun according to some embodiments presently disclosed.

Referring to FIGS. 1-3, a portion of a semi-automatic handgun 10 is shown according to some embodiments presently disclosed. The handgun 10 comprises a frame 15, a slide 20, a forward rail 25, and a rear rail 30. For clarity of illustration, only those parts of the handgun 10 which relate to the construction and operation of the frame 15 and slide 20 are shown. The other components of a semi-automatic handgun 10, such as the barrel, breech block, trigger, trigger bar, sear, striker, and various springs are well known in the art and are therefore do not require detailed description.

According to some embodiments presently disclosed, the frame 15 is formed from a polymeric material. According to some embodiments presently disclosed, the frame 15 is formed using a molding process. According to some embodiments presently disclosed, the frame 15 is injection molded. According to some embodiments presently disclosed, the semi-automatic handgun 10 is a Model 1911 type firearm. It is to be understood that the features presently disclosed may be applied to any type of handgun. It is to be understood that the features presently disclosed may be applied to any type of handgun with the frame formed from a polymeric material.

The frame 15 comprises a channel 35 (shown in FIGS. 1-3) that extends from the back end 40 to the front end 45 of the handgun 10. According to some embodiments presently disclosed, the forward rail 25 and the rear rail 30 are positioned within the channel 35 of the frame 15 (shown in FIGS. 1-3). According to some embodiments presently disclosed, the forward rail 25 and the rear rail 30 are made from metallic material.

Referring to FIGS. 6*a*-6*d*, according to some embodiments presently disclosed, the forward rail 25 comprises a first side panel 75, a second side panel 80 and a bottom panel 85. According to some embodiments, the bottom panel 85 is integrally coupled with the first side panel 75 and second side panel 80. According to some embodiments, the bottom panel 85 is substantially perpendicular to the first side panel 75 and second side panel 80. According to some embodiments, the first side panel 75 and the second side panel 80 are a first distance apart.

The first side panel 75 and the second side panel 80 comprise a tongue 50 that extends above the top of the frame 15. The tongue 50 corresponds to groves 55 (shown in FIG. 2) that extend within the slide 20. The tongue 50 and groves 55 combination of forward rail 25 and the slide 20 enable the slide 20 to travel back and forth along the frame 15.

Figure 4:
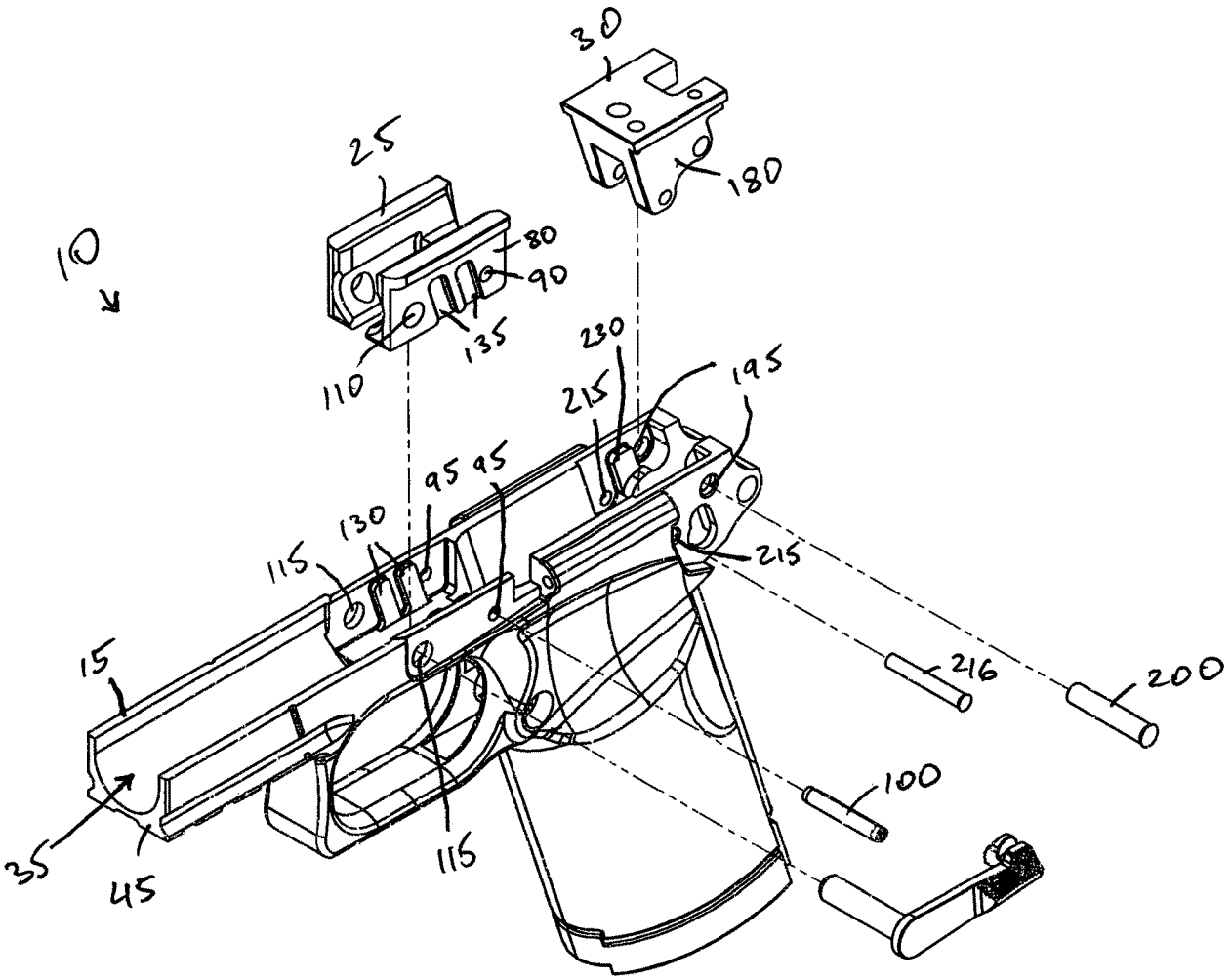
FIG. 4 depicts an exploded view of the portion of the handgun shown in FIG. 3.
Figure 5:
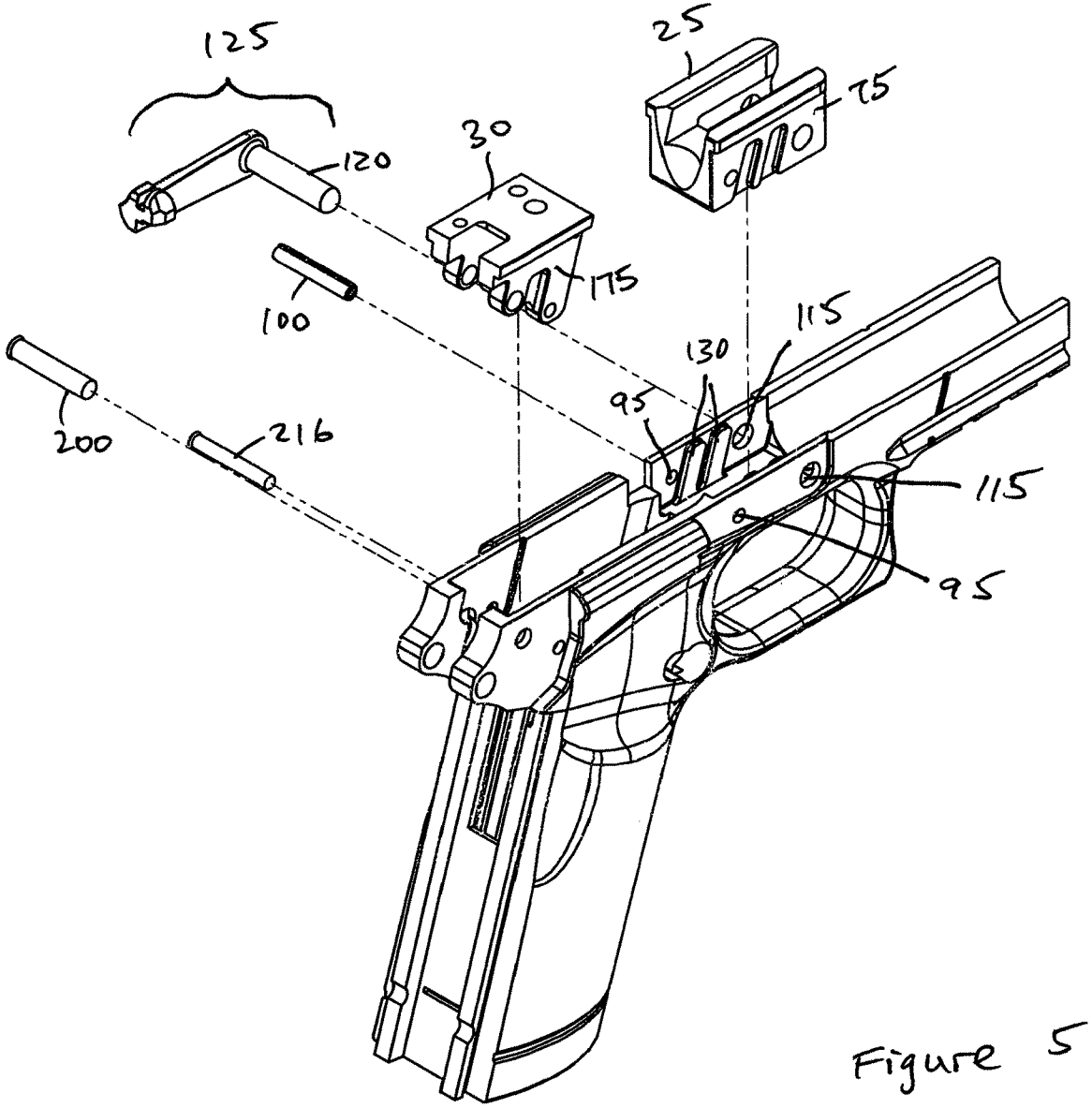
FIG. 5 depicts another exploded view of the portion of the handgun shown in FIG. 3.
Figure 6A:
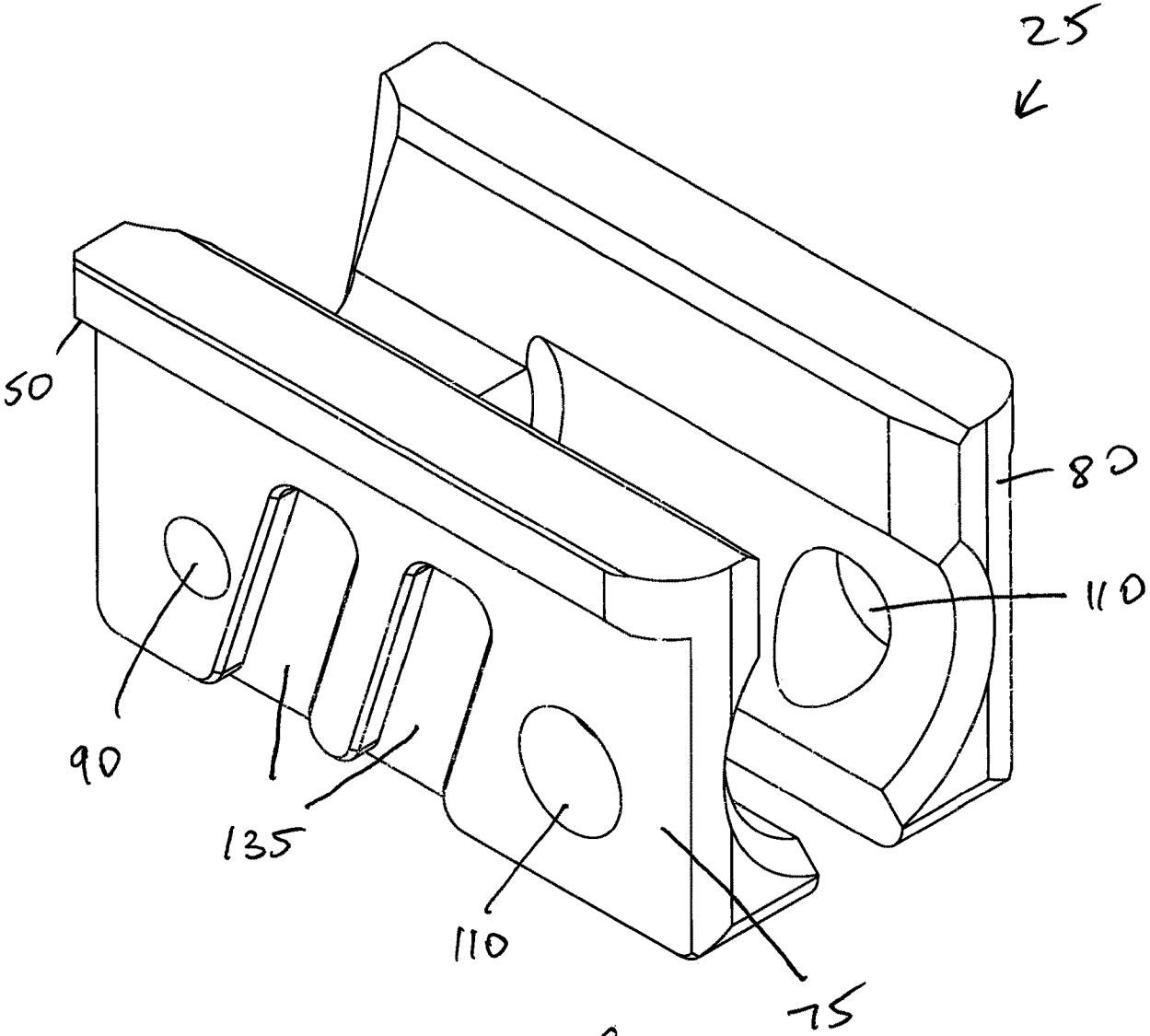
FIG. 6*a* depicts a perspective view of a forward rail according to some embodiments presently disclosed.
Figure 6B:
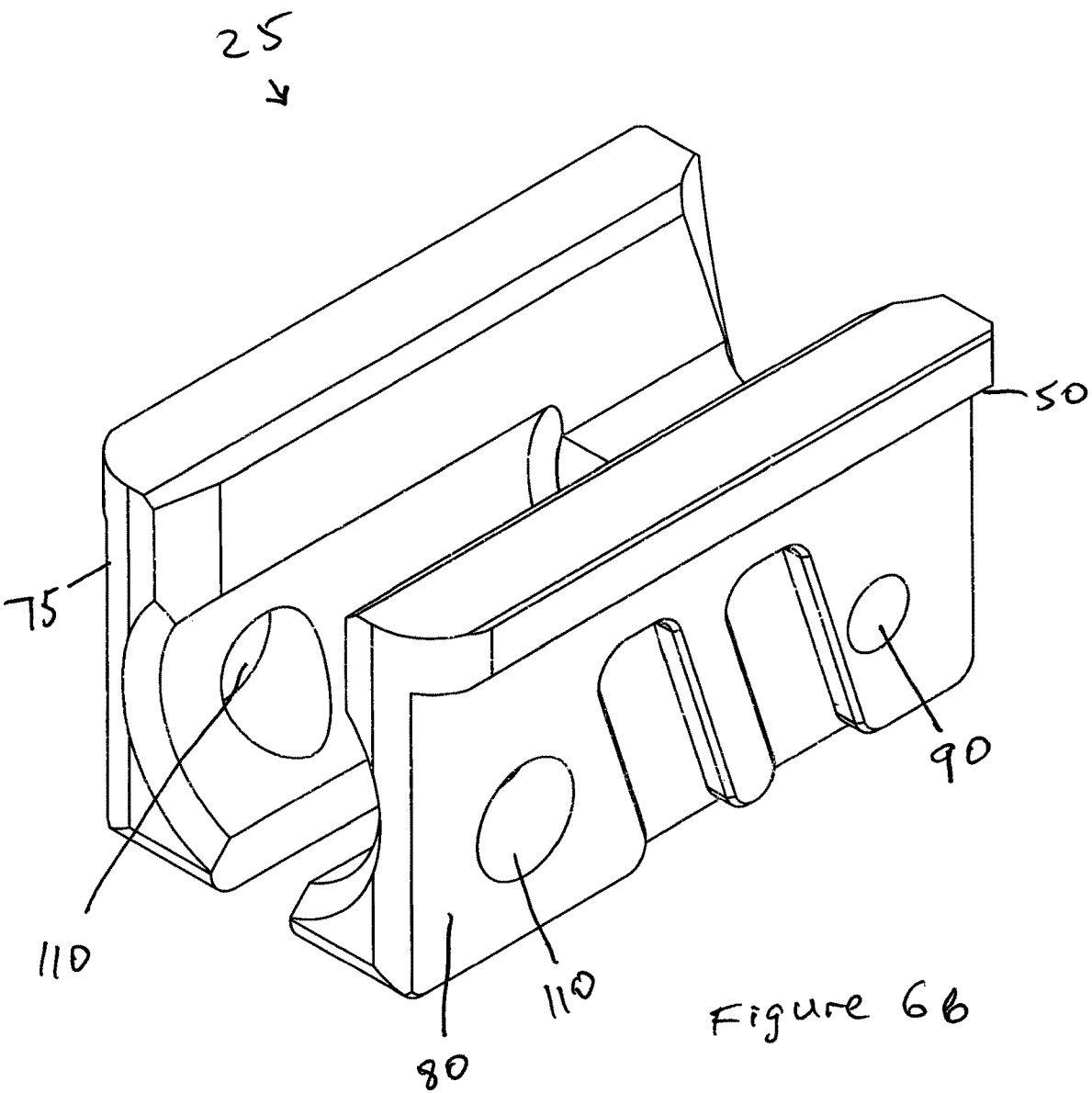
FIG. 6*b* depicts another perspective view of the forward rail shown in FIG. 6*a*.
Figure 6C:
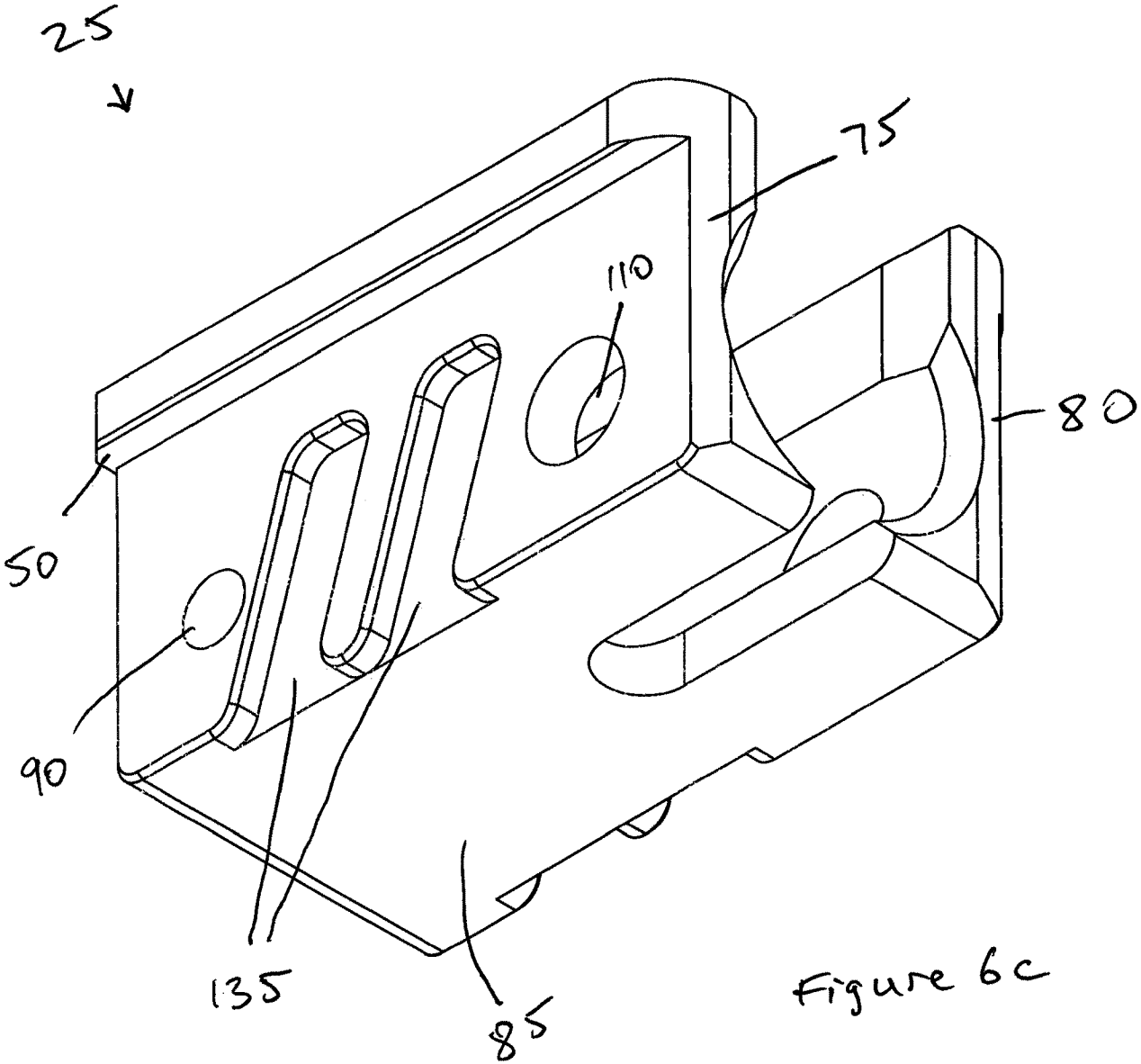
FIG. 6*c* depicts another perspective view of the forward rail shown in FIG. 6*a*.
Figure 6D:
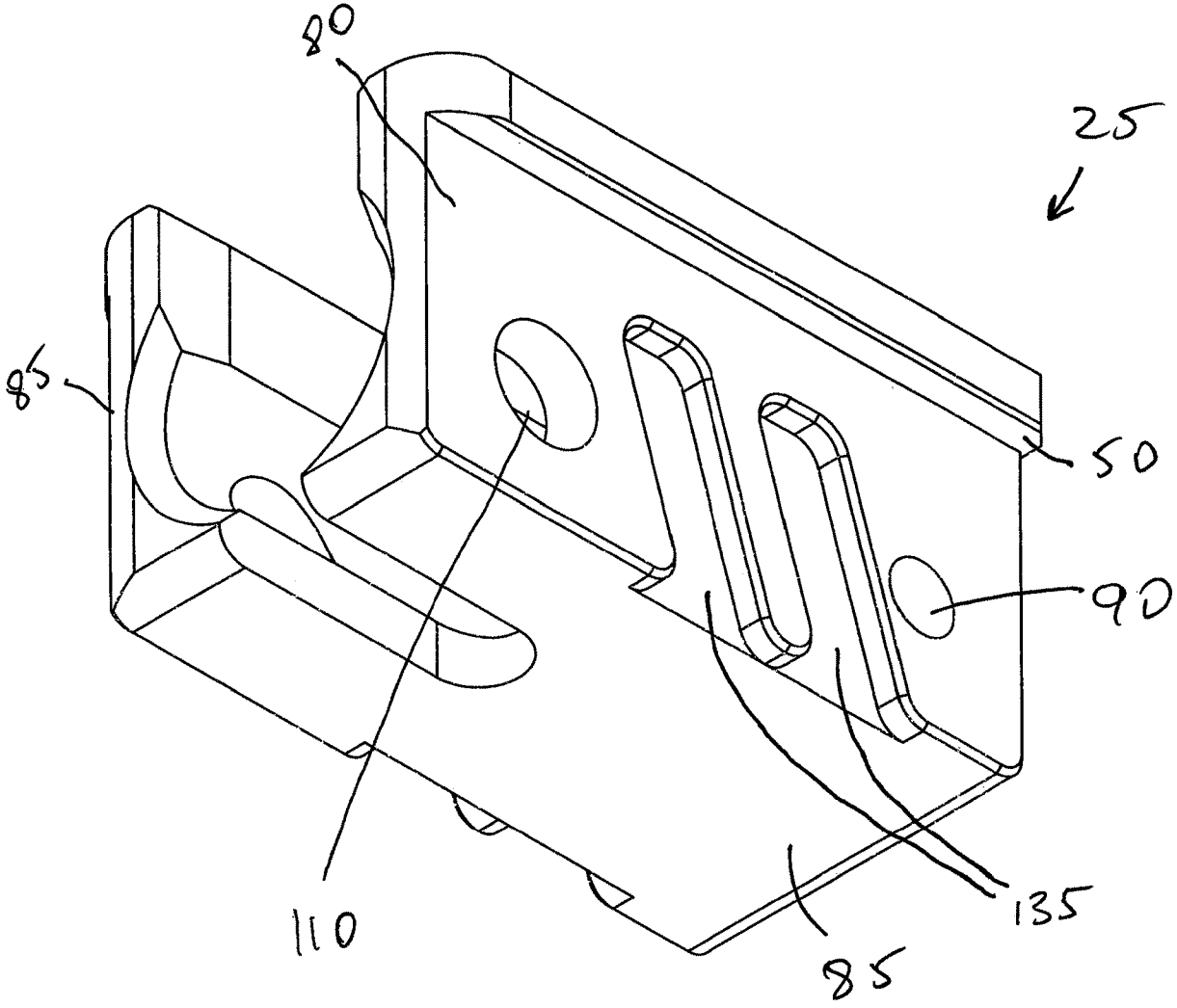
FIG. 6*d* depicts another perspective view of the forward rail shown in FIG. 6*a*.
Figure 7A:
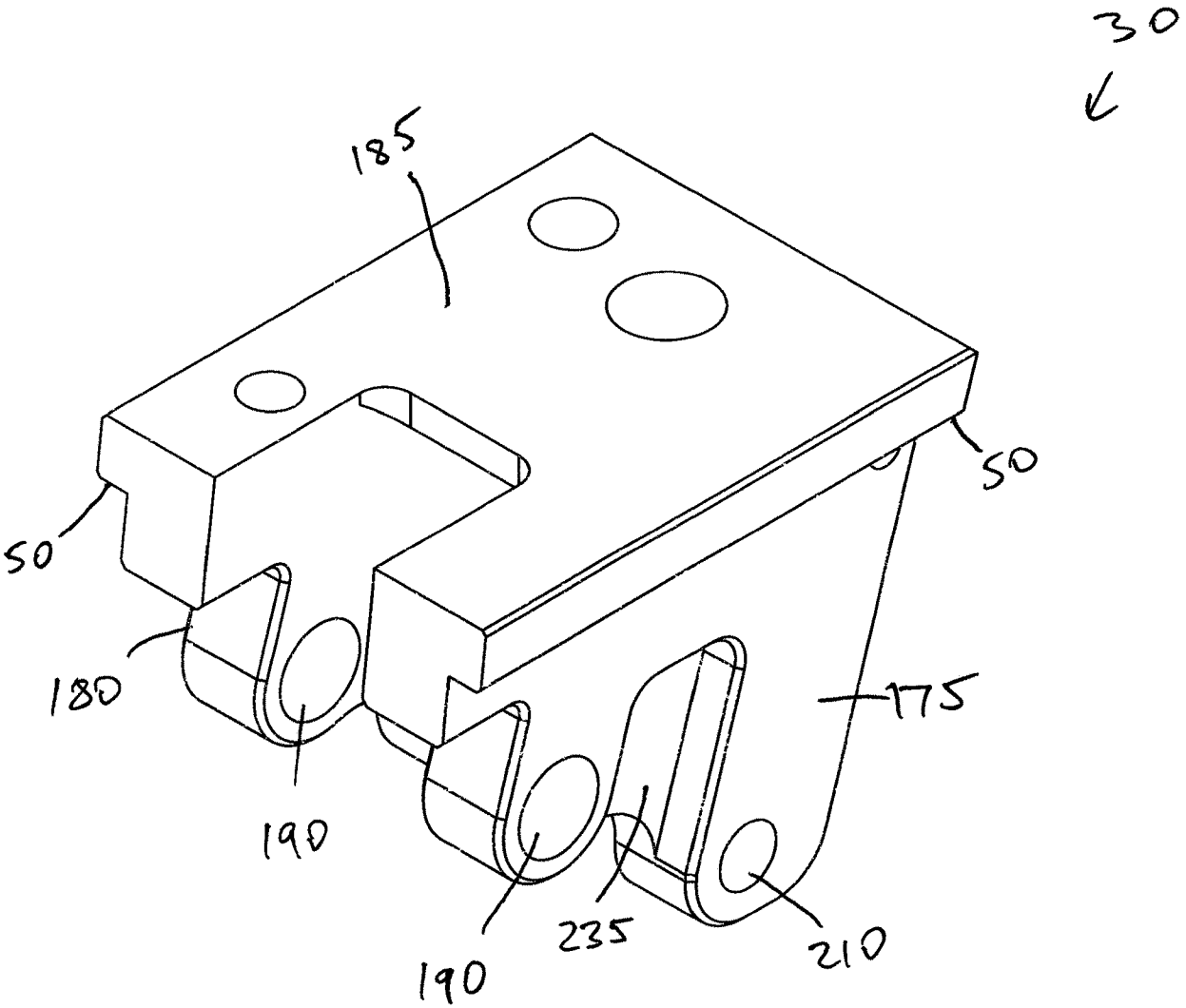
FIG. 7*a* depicts a perspective view of a rear rail according to some embodiments presently disclosed.
Figure 7B:
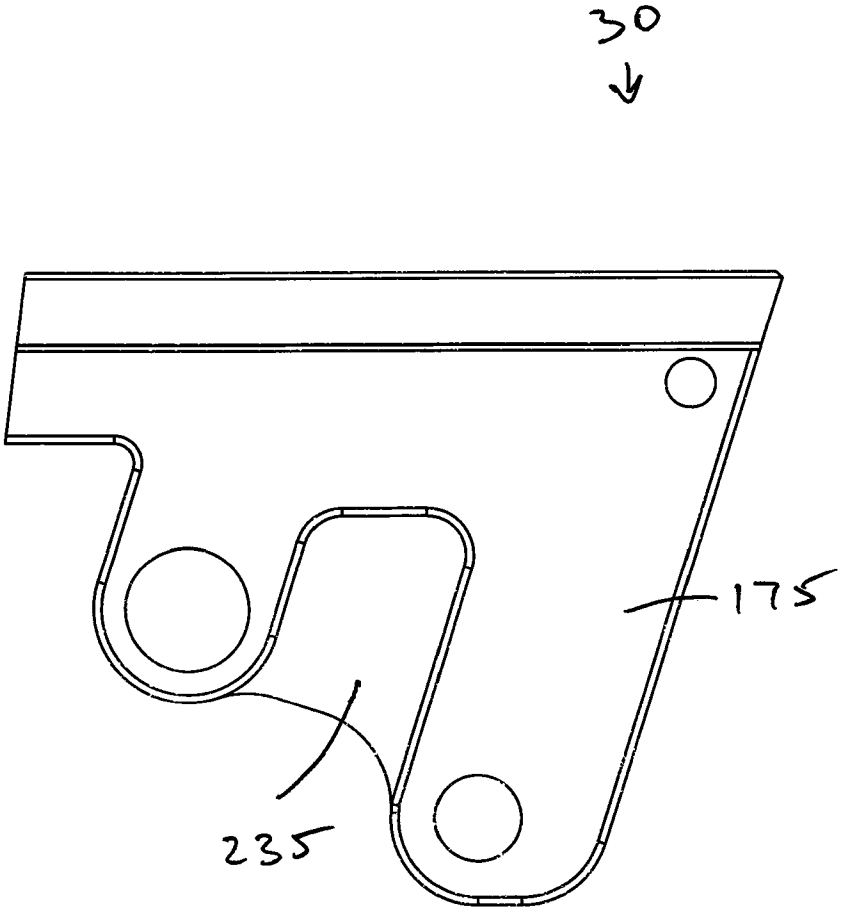
FIG. 7*b* depicts a side view of the rear rail shown in FIG. 7*a*.
Figure 7C:
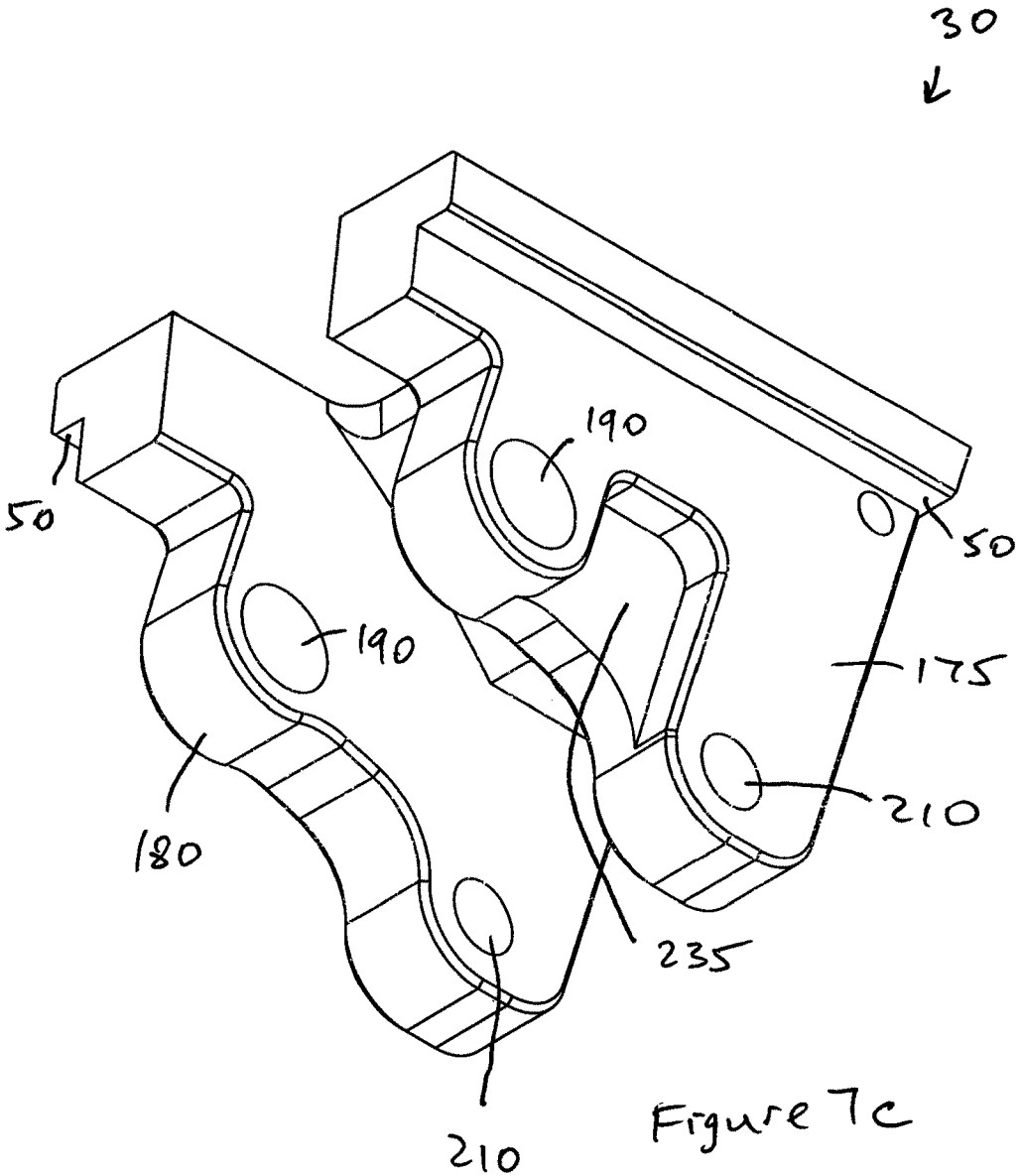
FIG. 7*c* depicts another perspective view of the rear rail shown in FIG. 7*a*.
Figure 7D:
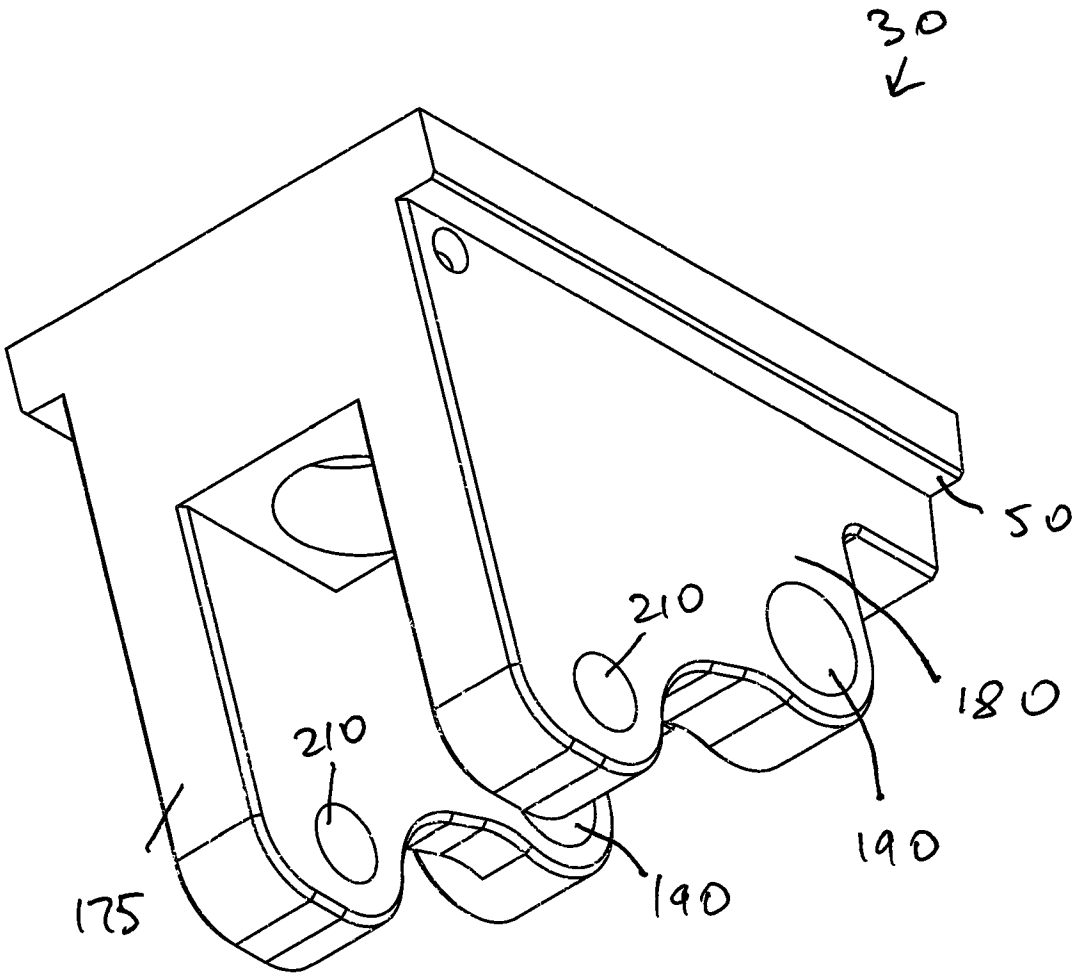
FIG. 7*d* depicts another perspective view of the rear rail shown in FIG. 7*a*.
Figure 7E:
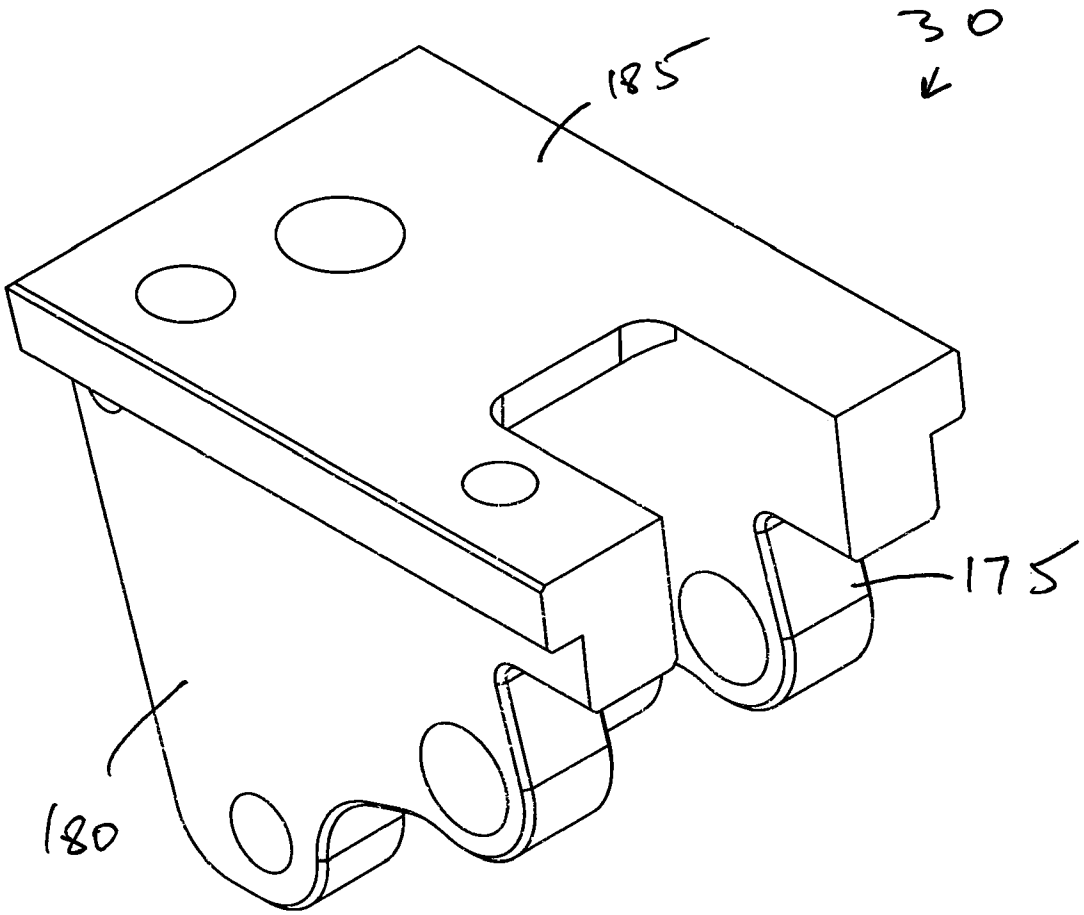
FIG. 7*e* depicts another perspective view of the rear rail shown in FIG. 7*a*.
Figure 7F:
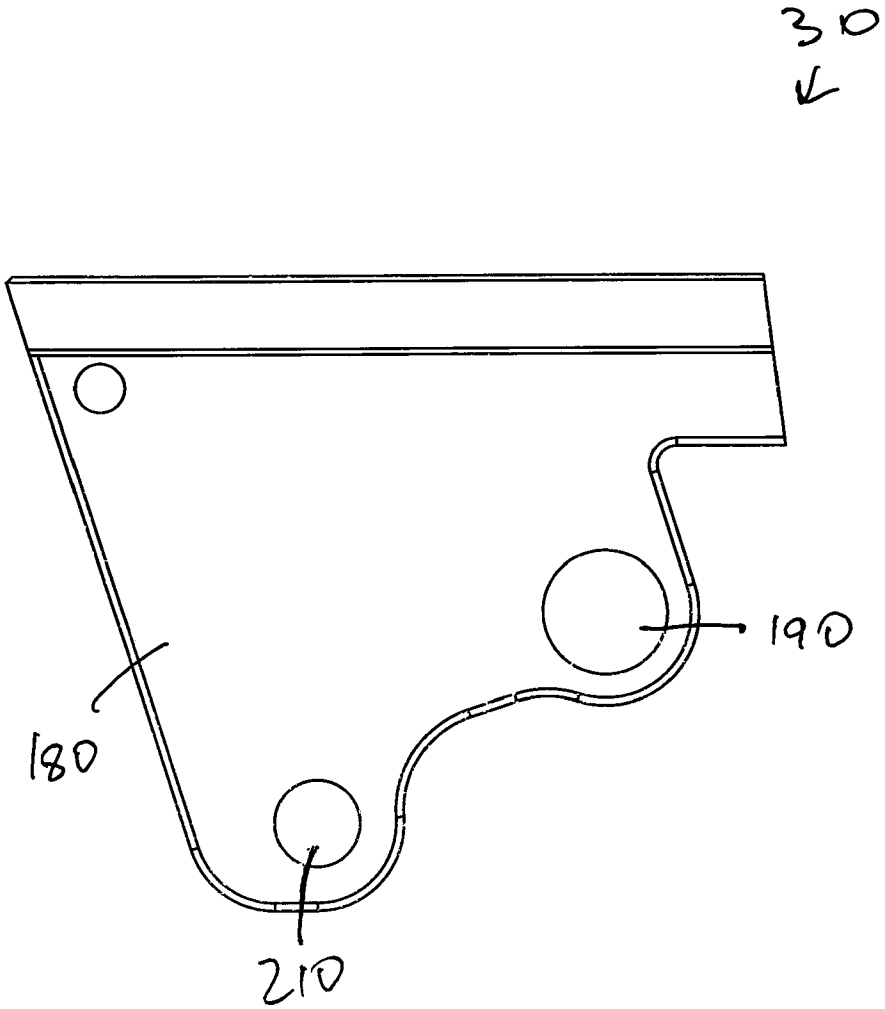
FIG. 7*f* depicts another side view of the rear rail shown in FIG. 7*a*.

According to some embodiments presently disclosed, the first side panel 75 and the second side panel 80 comprise through-holes 90 (shown in FIGS. 6*a*-6*d*) configured to align with a respective through-holes 95 (shown in FIGS. 4-5) of the frame 15 whereby a pin 100 is inserted into and passes within each through-hole 90, 95 to secure the frame 15 with the first side panel 75 and the second side panel 80.

According to some embodiments presently disclosed, the first side panel 75 and the second side panel 80 comprise slide stop through-holes 110 (shown in FIGS. 6*a*-6*d*) configured to align with a respective slide stop through-holes 115 (shown in FIGS. 4-5) of the frame 15 whereby a rotation pin 120 of a slide stop mechanism 125 is inserted into and passes within each slide stop through-holes 110, 115 to secure the frame 15 with the first side panel 75 and the second side panel 80.

According to some embodiments presently disclosed, the frame 15 comprises one or more protrusions 130 (shown in FIGS. 4-5) in the channel 35. According to some embodiments presently disclosed, one or both inner surfaces of the channel 35 comprise the one or more protrusions 130. According to some embodiments, the first side panel 75 and/or the second side panel 80 comprise one or more openings (i.e. cavities) 135 (shown in FIGS. 6*a*-6*d*) shaped to match the one or more protrusions 130. According to some embodiments, the one or more openings 135 lineup with and slide over the one or more protrusions 130 when the first side panel 75 and/or the second side panel 80 are placed in the channel 35.

Referring to FIGS. 7*a*-7*f*, according to some embodiments presently disclosed, the rear rail 30 comprises a first side panel 175, a second side panel 180 and a top panel 185. According to some embodiments, the top panel 185 is integrally coupled with the first side panel 175 and second side panel 180. According to some embodiments, the top panel 185 is substantially perpendicular to the first side panel 175 and second side panel 180. According to some embodiments, the first side panel 175 and the second side panel 180 are a first distance apart.

The first side panel 175 and the second side panel 180 comprise the tongue 50 that extends above the top of the frame 15. The tongue 50 corresponds to groves 55 that extend within the slide 20. The tongue 50 and groves 55 combination of rear rail 30 and the slide 20 enable the slide 20 to travel back and forth along the frame 15.

According to some embodiments presently disclosed, the first side panel 175 and the second side panel 180 comprise through-holes 190 (shown in FIGS. 7*a*-7*f*) configured to align with a respective through-holes 195 (shown in FIGS. 4-5) of the frame 15 whereby a pin 200 is inserted into and passes within each through-hole 190, 195 to secure the frame 15 with the first side panel 175 and the second side panel 180.

According to some embodiments presently disclosed, the first side panel 175 and the second side panel 180 comprise another through-holes 210 (shown in FIGS. 7*a*-7*f*) configured to align with a respective through-holes 215 (shown in FIGS. 4-5) of the frame 15 whereby another pin 216 is inserted into and passes within each through-hole 210, 215 to secure the frame 15 with the first side panel 175 and the second side panel 180.

According to some embodiments presently disclosed, the frame 15 comprises one or more protrusions 230 (shown in FIG. 4) in the channel 35. According to some embodiments presently disclosed, at least one inner surfaces of the channel 35 comprises the one or more protrusions 230. According to some embodiments, the first side panel 175 comprises one or more openings (i.e. cavities) 235 (shown in FIGS. 7*a*-7*c*) shaped to match the one or more protrusions 230. According to some embodiments, the one or more openings 235 lineup with and slide over the one or more protrusions 230 when the first side panel 175 is placed in the channel 35.

According to some embodiments presently disclosed, the forward rail 25 and/or the rear rail 30 are casted parts. After the casting, the forward rail 25 is processed by machining the holes 90, 110, and by machining the openings 135. After the casting, the rear rail 30 is processed by machining the holes 190, 210, by machining the openings 235. According to some embodiments presently disclosed, at least a portion of the forward rail 25 is casted larger than the final finished product. After the casting, the forward rail 25 is machined to correct dimensions. According to some embodiments presently disclosed, at least a portion of the rear rail 30 is casted larger than the final finished product. After the casting, the rear rail 30 is machined to correct dimensions.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A rail comprising:

a first side panel, wherein the first side panel comprises a first tongue along the entire length of the first side panel; and a second side panel, wherein the second side panel comprises a second tongue along the entire length of the second side panel;

wherein the first tongue and the second tongue are for engaging grooves of a slide;

wherein the first tongue extends away from the second panel and the second tongue extends away from the first panel;

wherein the first panel comprises a first cavity for engaging a protrusion of a frame of a handgun.

2. The rail of claim 1, wherein the rail is a forward rail.

3. The rail of claim 1, wherein the rail a rear rail.

4. The rail of claim 1, wherein the first side panel comprises a first through-hole and the second side panel comprise a second through-hole, wherein the first through-hole and the second through-hole are configured to accommodate a rotation pin of a slide stop.

5. The rail of claim 1, wherein the first side panel comprises a first through-hole and the second side panel comprise a second through-hole, wherein the first through-hole and the second through-hole are configured to accommodate a first pin.

6. The rail of claim 5, wherein the first side panel comprises a third through-hole and the second side panel comprise a fourth through-hole, wherein the third through-hole and the fourth through-hole are configured to accommodate a second pin.

7. The rail of claim 6, wherein the rail a rear rail.

8. A rail comprising:

a first side panel, wherein the first side panel comprises a first tongue along the entire length of the first side panel; and a second side panel, wherein the second side panel comprises a second tongue along the entire length of the second side panel;

wherein the first tongue and the second tongue are for engaging grooves of a slide;

wherein the first side panel comprises a first through-hole and the second side panel comprise a second through-hole, wherein the first through-hole and the second through-hole are configured to accommodate a rotation pin of a slide stop;

wherein the first side panel comprises a third through-hole and the second side panel comprise a fourth through-hole, wherein the third through-hole and the fourth through-hole are configured to accommodate a pin.

9. The rail of claim 8, wherein the rail comprises a first cavity for engaging a protrusion of a frame of a handgun.

10. The rail of claim 8, wherein the rail is a forward rail.

* * * * *